US005396150A

United States Patent [19]

Wu et al.

[11] Patent Number: 5,396,150

[45] Date of Patent: Mar. 7, 1995

[54] SINGLE TIP REDUNDANCY METHOD AND RESULTING FLAT PANEL DISPLAY

[75] Inventors: Biing-Seng Wu, Hsinchu; Jammy C.-M. Huang, Taipei, both of Taiwan, Prov. of China

[73] Assignee: Industrial Technology Research Institute, Hsinchu, Taiwan, Prov. of China

[21] Appl. No.: 84,484

[22] Filed: Jul. 1, 1993

[51] Int. Cl.[6] ..... H01J 1/30

[52] U.S. Cl. ..... 313/495; 313/309

[58] Field of Search ..... 313/495–497, 313/306–309, 336, 351, 422

[56] References Cited

U.S. PATENT DOCUMENTS

| | | | |
|---|---|---|---|
| 4,513,308 | 4/1985 | Greene et al. | 313/309 |
| 4,575,765 | 3/1986 | Hirt | 313/309 |
| 4,835,438 | 5/1989 | Baptist et al. | 313/351 |
| 5,075,591 | 12/1991 | Holmberg | 313/495 |
| 5,162,704 | 11/1992 | Kobori et al. | 313/309 |
| 5,199,917 | 4/1993 | MacDonald et al. | 313/351 |
| 5,219,310 | 6/1993 | Tomo et al. | 313/309 |
| 5,229,331 | 7/1993 | Doan et al. | 313/309 |
| 5,258,685 | 11/1993 | Jaskie et al. | 313/309 |
| 5,319,279 | 6/1994 | Watanabe et al. | 313/309 |

*Primary Examiner*—Stephen Brinich

*Attorney, Agent, or Firm*—George O. Salle; Stephen B. Ackerman

[57] ABSTRACT

A high resolution matrix addressed flat panel display having single field emission microtip redundancy is formed. A dielectric base substrate is provided. Parallel, spaced conductors acting as cathode columns for the display are formed upon the substrate. A layer of insulation is located over the cathode columns. Parallel, spaced conductors acting as gate lines for the display is formed over the layer of insulation at a right angle to the cathode columns. The intersections of the cathode columns and gate lines are the pixels of the display. A plurality of openings at the pixels extend through the insulating layer and gate lines. At each of the pixels are a plurality of field emission microtips connected to and extending up from the cathode conductor columns and into the plurality of openings. There is a circular resistive layer surrounding each of the field emission microtips to obtain emission uniformity by sustaining the cathode to gate voltage.

27 Claims, 10 Drawing Sheets

SINGLE TIP REDUNDANCY METHOD AND RESULTING FLAT PANEL DISPLAY

BACKGROUND OF THE INVENTION

1. Field of the Invention

The invention relates to field emission flat panel displays, and more particularly to methods for making a high resolution matrix addressed flat panel display having single field emission microtip redundancy and the resulting display.

2. Description of the Prior Art

U.S. Pat. No. 4,763,187 to J. P. Biberian generally discusses field emission device structures including tips emitting electrons to light a fluorescent screen, using lines and columns for addressing. The structure includes a grid, at a third voltage potential (the first two potentials being those of the cathode and anode) which is used to control electron emission intensity. Biberian says that the grid solves the problem of needing low voltage levels (to allow for fast switching) but without requiring very small spacing, on the order of a few microns, between the tips and the anode structure. A few micron spacing would cause great difficulty in manufacturing. His structure using the grid also allows for the separate control of the address and intensity functions.

Another matrix addressed flat panel display is shown in U.S. Pat. No. 4,857,799 by C. A. Spindt et al. He refers to U.S. Pat. No. 3,500,102 by Crost et al which deals with a thin display using field emission, but which did not deal with gaseous breakdown, and which would still have a problem of distortion in the display picture, due to screen deflection from pressure difference between atmospheric pressure and vacuum inside display. Solutions to this problem proposed by Spindt et al included: 1) a "support structure" to prevent the distortion, 2) spacing between the cathodes and luminescent material which is less than or equal to the mean free path of electrons in the interelectrode space—this would help reduce gas breakdown, and 3) isolating the cathode conductive lines by using semiconductive material between the conductive lines, to reduce crosstalk.

The U.S. Pat. No. 4,857,161 to Borelet al shows a process for the production of an array of cathode lines and grid lines that are used to address each picture element. At each picture element there are many microemitters that are grown on the corresponding cathode line. The many micro-emitters provide redundancy, so that if one emitter fails, there is no degradation in the display.

The U.S. Pat. No. 4,940,916 to Borel et al addresses two problems with the Borel et al 4,857,161, that is cathode destruction, and non-uniform emission or "bright spots" on the display. During startup of the display, current surges due to degasification occur, including arcing between the grids, points and anodes, leading to cathode destruction (the cathode is unable to carry current and opens). Initially a resistor was added between the power source and the cathode lines, but under certain conditions this led to the bright spots. His solution was to add a resistive layer covering the cathode layer and under the microtips. His purpose is to prevent cathode destruction and offer good thermal dissipation.

The resistive layer approach described by Borel et al still has the problem that it cannot sustain cathode-gate voltage, and subsequent explosions cause a dead short between the gate and cathode. A solution for this is proposed by A. Meyer in "RECENT DEVELOPMENT ON 'MICROTIPS' DISPLAY AT LETI" in TECHNICAL DIGEST of IVMC 91 NAGAHAMA 1991 PAGES 6 to 9. The solution is to form a meshed conductor of the cathode lines. This has the effect of moving the cathode farther from the emitters for a longer resistive path. The conductor mesh also provides additional redundancy.

However, the meshed conductor of Meyer has less value as the display resolution is increased and/or a smaller pixel size is desired. Therefor, the resolution is unsatisfactory to the pixel sizes needed today.

SUMMARY OF THE INVENTION

An object of this invention is to provide a high resolution matrix addressed flat panel display having single field emission microtip redundancy which is satisfactory for pixel sizes needed by today's displays.

Another object of this invention is to provide a very manufacturable method of fabricating a high resolution matrix addressed flat panel display having single field emission microtip redundancy which is satisfactory for pixel sizes needed by today's displays.

The flat panel display having single field emission microtip redundancy features the addition of a circular resistive layer around each field emission microtip. This circular resistive layer can be located a) at the gate layer b) at the cathode layer c) at both layers or d) create an entire resistive layer over the cathode and use the gate circular layer around the microtip. The resistances of the circular layer in a matrix-addressed flat panel display can be different, which can provide a different load resistance for each microtip and/or different operation point.

A high resolution matrix addressed flat panel display having single field emission microtip redundancy is formed. A dielectric base substrate is provided. Parallel, spaced conductors acting as cathode columns for the display are formed upon the substrate. A layer of insulation is located over the cathode columns. Parallel, spaced conductors acting as gate lines for the display is formed over the layer of insulation at a right angle to the cathode columns. The intersections of the cathode columns and gate lines are the pixels of the display. A plurality of openings at the pixels extend through the insulating layer and gate lines. At each of the pixels are a plurality of field emission microtips connected to and extending up from the cathode conductor columns and into the plurality of openings. There is a circular resistive layer surrounding each of the field emission microtips to obtain emission uniformity by sustaining the cathode to gate voltage.

The method of fabricating a high resolution matrix addressed flat panel display having cathode columns and gate lines and single field emission microtip redundancy is done as follows. A dielectric base substrate is provided. Parallel, spaced conductors acting as cathode columns for the display are formed upon the substrate. A layer of insulation is formed over the cathode columns. The intersections of the cathode columns and gate lines are the pixels of the display. Spaced conductors are formed which act as gate lines for the display over the layer of insulation at a right angle to the cathode columns. A plurality of openings are formed at the pixels extending through the insulating layer and the gate lines. There is formed at each of the pixels a plurality of field emission microtips connected to and extending up from the cathode conductor columns and into the plurality of openings forming parallel. There is provided a circular resistive layer surrounding each of the field emission microtips to obtain emission uniformity by sustaining the cathode to gate voltage.

DESCRIPTION OF THE PREFERRED EMBODIMENTS

Figure 1:
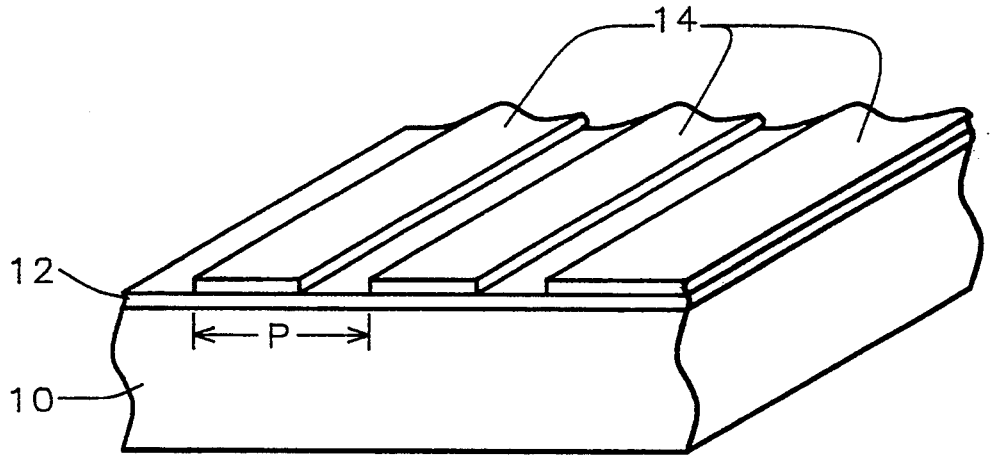
FIGS. 1, 2A, 2B, 2C, 2D, 3A, 3B, 4, 5, 6, 7, 8, 9, 10A, 10B and 11 show a first embodiment method for fabricating the high resolution flat panel display having single field emission microtip redundancy and resulting structure.

Referring now to FIGS. 1 through 11 the first embodiment will be described. A dielectric substrate 10 is chosen. The substrate is typically glass, silicon wafer, or the like. If glass, it is preferred to use Corning 7740 or 7059. Depending upon the type of substrate used it may be preferred to use a dielectric layer 12 over the surface of the substrate 10. Such a layer may be for example, aluminum oxide ($Al_2O_3$) or silicon dioxide ($SiO_2$) which would be deposited or thermally grown (in the case of $SiO_2$) by conventional integrated circuit processes and having a thickness of between about 5,000 to 20,000 Angstroms. Usually this layer is used to obtain good adhesion for subsequent layers. When a silicon substrate is used for substrate 10, a thermally grown oxide is preferred for dielectric layer 12. If a glass substrate 10 is used, then a deposited $SiO_2$ or $Al_2O_3$ is preferred. A conductive layer 14 composed of molybdenum, aluminum, tungsten, etc, or doped polysilicon is deposited by sputtering, electron beam evaporation or chemical vapor deposition (CVD) and has a thickness of between about 500 to 10,000 Angstroms. The layer 14 is patterned by conventional lithography and etching techniques into parallel, spaced conductors 14 acting as cathode columns for the display being formed upon the substrate 10 and dielectric 12. Alternatively, the insulating layer 12 may not be used. We have shown the presence of this layer 12 in FIG. 1, but have left it out in subsequent Figures. Each spaced conductor 14 has a width of between about 0.1 to 0.3 mm., a distance between conductors of between about 0.005 to 0.1 mm, and a spacing P of between about 0.105 to 0.4 mm. This results in the FIG. 1 structure.

Figure 2A:
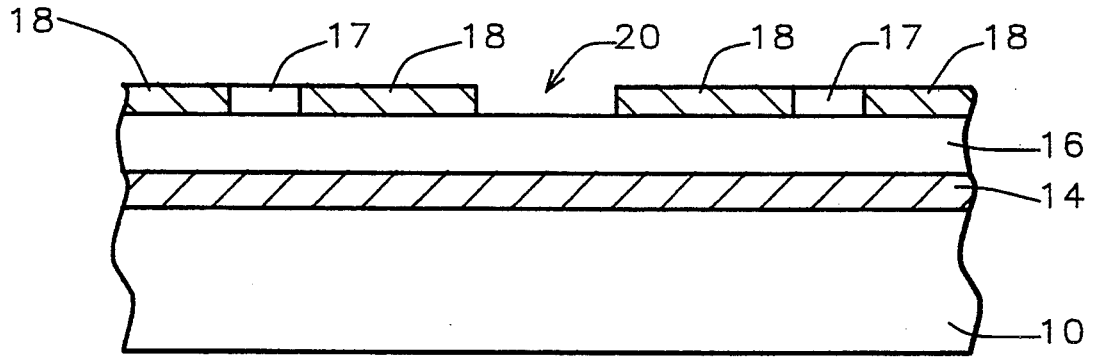
Figure 2B:
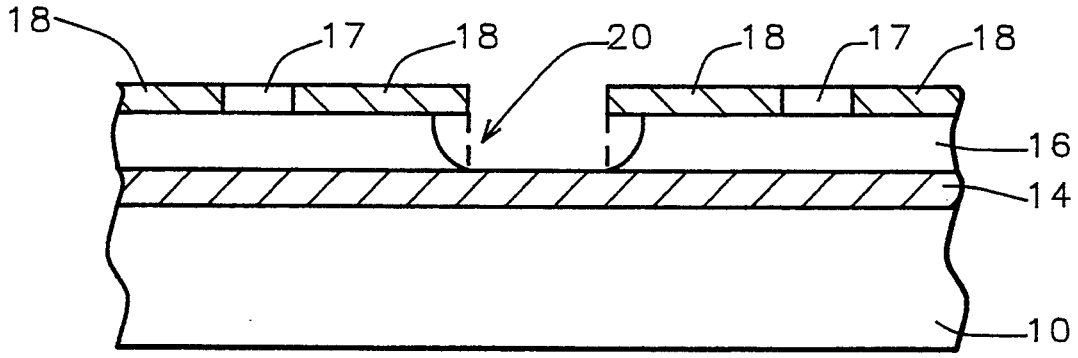

Referring now to FIG. 2A, the process continues by forming an insulator layer 16 which is preferably silicon oxide (SiO), but could alternatively be aluminum oxide ($Al_2O_3$). This layer 16 is deposited by sputtering, e-beam evaporation, or CVD, and has a thickness of between about 5,000 to 20,000 Angstroms. In one method, layer 18 is now deposited using amorphous silicon or polycrystalline silicon, typically deposited by Low Pressure Chemical Vapor Deposition (LPCVD), to a thickness of between about 1800 to 2200 Angstroms. Layer 18 forms the gate lines for the display. Conventional lithography techniques are used to form a pattern to ion implant layer 18 except in regions 17.

In a critical step in the invention, another ion implant is then performed only in regions 17, using conventional lithography and etching, to form a circular resistive region with resistive value of between about 1 megaohm to 100 gigaohms. The outer diameter of circular resistive region 17 is between about 4 and 5 microns, and the width is about 0.5 micron, such that the inner diameter is about 1 micron less than the outer diameter. After the formation of the pattern of circular resistive regions 17 at the intersections, that is pixels of the cathode columns and gate lines are formed, a pattern of openings 20 at the center point of the circular resistive layer in the gate lines 18 are made, by conventional lithography and etching.

Figure 2C:
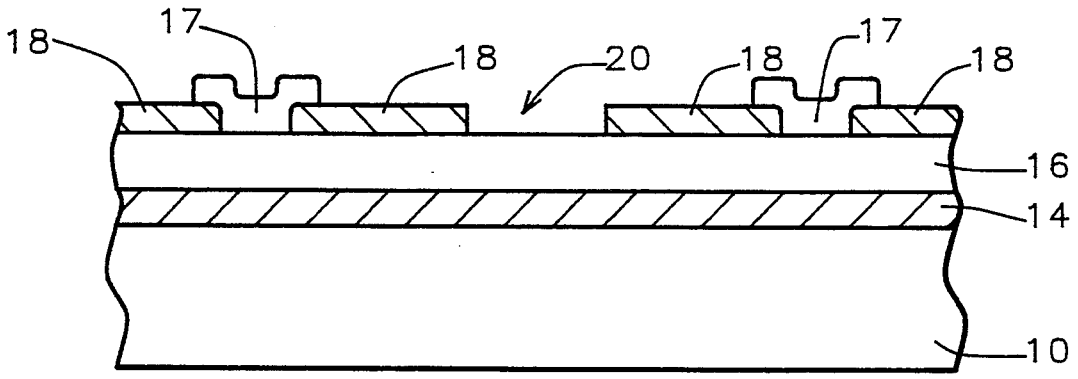
Figure 2D:
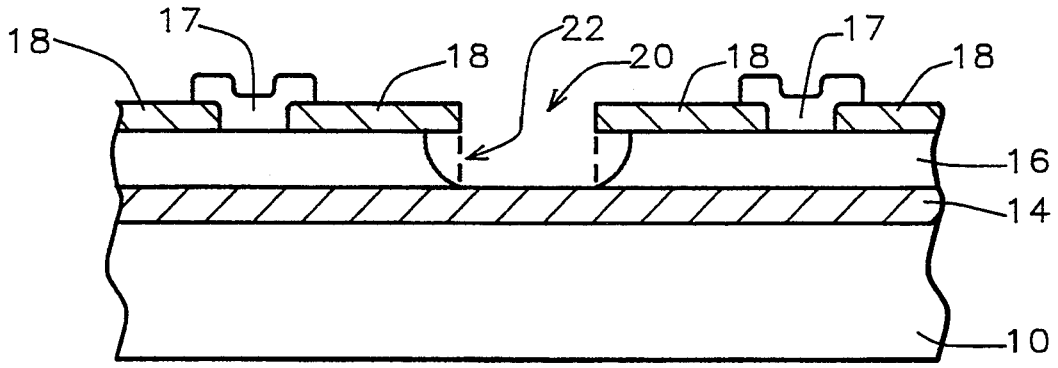

In a second method for creating circular resistive region 17, metal or doped polysilicon is deposited by conventional means to form layer 18, to a thickness of between about 1800 and 2200 Angstroms. Conventional lithography and etching are used to etch out regions 17 and 20. A layer of amorphous silicon or polycrystalline silicon (not shown) is deposited to the same thickness of between about 1800 and 2200 Angstroms, filling regions 17 and 20. This layer is now ion implanted to establish a resistive value of between about 1 megaohm to 100 gigaohms. This layer is etched, after patterning a photoresist using conventional lithography and etching, to remove all of the layer except that in region 17, by conventional etching, thus forming the circular resistive region 17 with opening 20 as shown in FIG. 2C. Region 17 has the same diameter and width as in the first method.

Figure 3A:
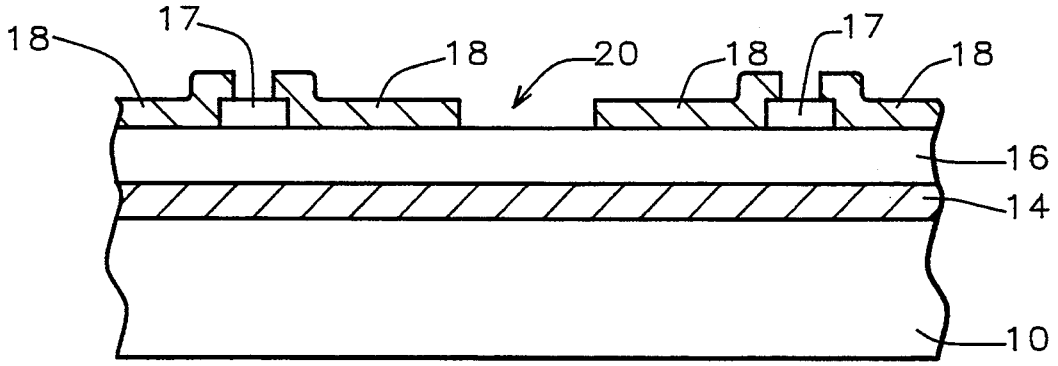
Figure 3B:
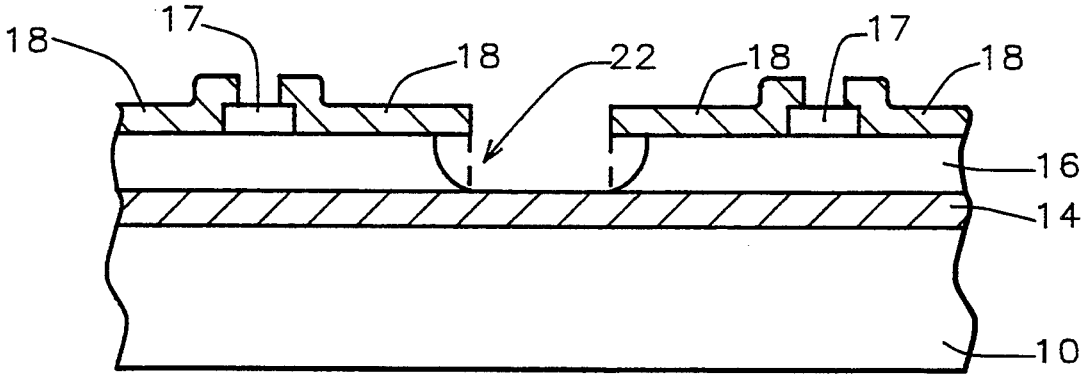

In a third method for forming circular resistive region 17, referring now to FIG. 3A, a layer of amorphous silicon or polycrystalline silicon is deposited over layer 16 to a thickness of between about 1800 and 2200 Angstroms. An ion implant is performed to create a resistive value of between about 1 megaohm and 100 gigaohms. This layer is then patterned to form circular resistive region 17 using a standard etch. A layer of metal 18 is deposited on layer 16 and on circular resistive region 17 to a thickness of between about 1800 and 2200 Angstroms. Conventional lithography and etching techniques are used to pattern a resist layer to enable an etch of region 20 and to expose region 17. Region 17 has the same diameter and width as in the first method.

Insulator layer 16 is now etched by reactive ion etching followed by a short isotropic chemical etch to form the enlarged openings 22 which undercut the opening 20. The etching ambient or chemical is chosen to stop at the cathode columns 14 and is conventional. This results in the structures shown in FIGS. 2B, 2D, and 3B.

Figure 4:
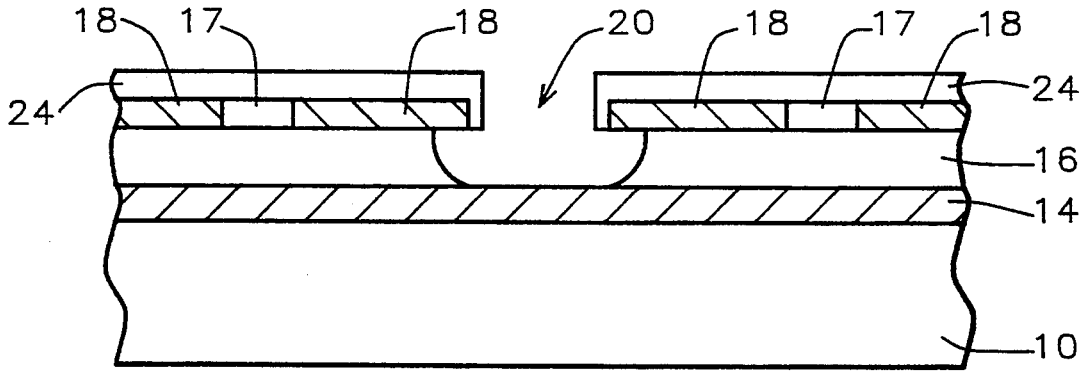
Figure 5:
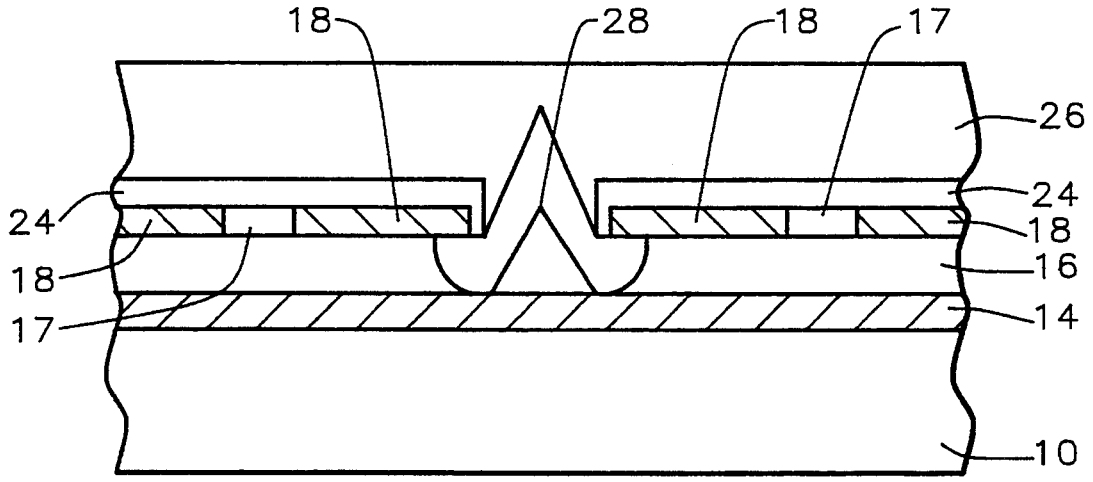

Referring now to FIG. 4, there is shown the critical method used to form the field emission microtip redundancy pattern. A sacrificial layer 24 of, for instance, nickel, is deposited by e-beam evaporation using graze angle deposition (to prevent filling of opening 20) by tilting the wafer at an angle of 75°. The thickness of this layer is about 1500 Angstroms. In FIG. 5, a layer of molybdenum is deposited vertically to a thickness of 18,000 Angstroms, thus forming field emission microtips 28 which are connected to cathode conductor 14 and have a height of between about 12,000 and 15,000 Angstroms.

Figure 6:
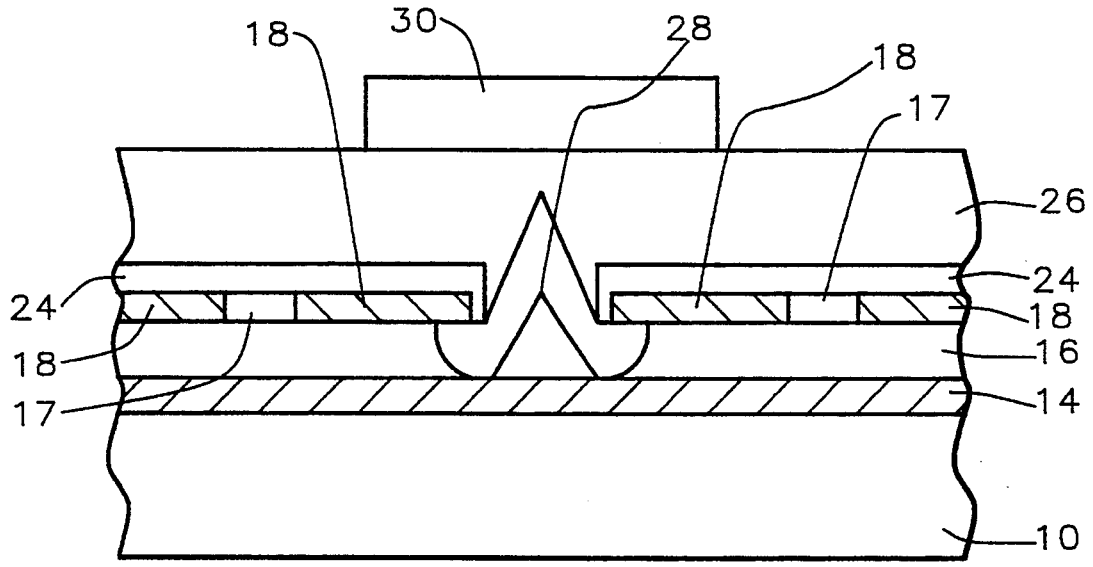
Figure 7:
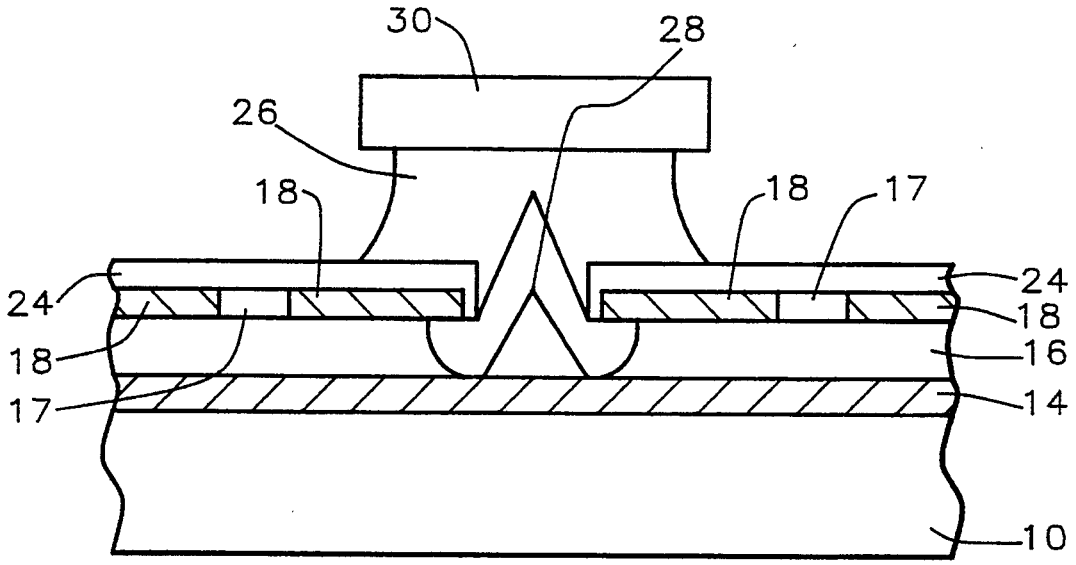
Figure 8:
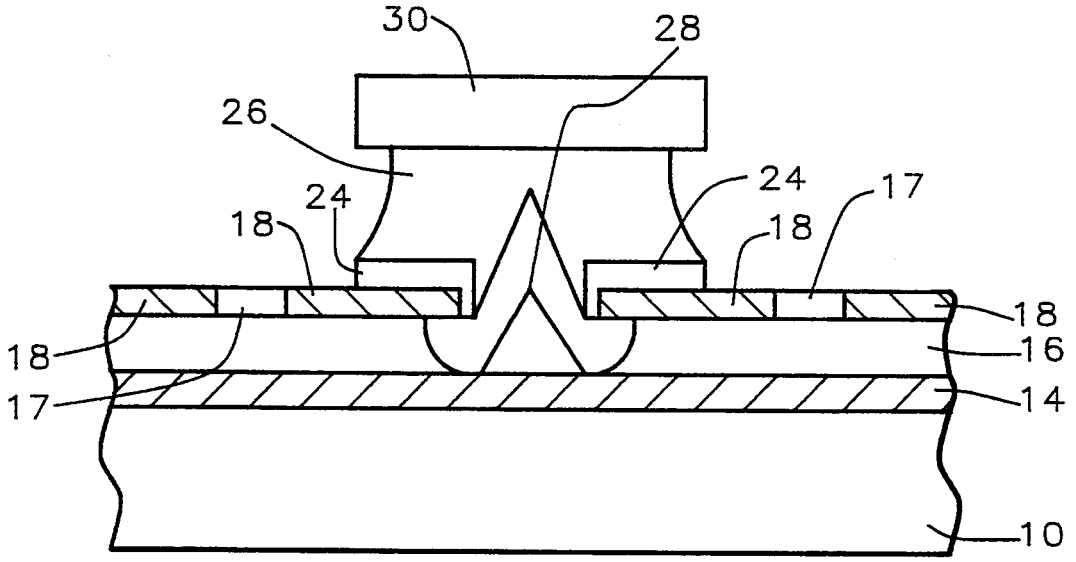

Referring now to FIG. 6, tip protection layer 30 is deposited and patterned by conventional means over each microtip. As shown in FIG. 7, layer 26 is removed in all areas not protected by layer 30 by a dry etch, using sacrificial layer 24 as an etch stop. Layer 24 is now electrochemically removed in those areas not masked by patterned tip protection layer 30, as shown in FIG. 8, to expose gate line 18.

Figure 9:
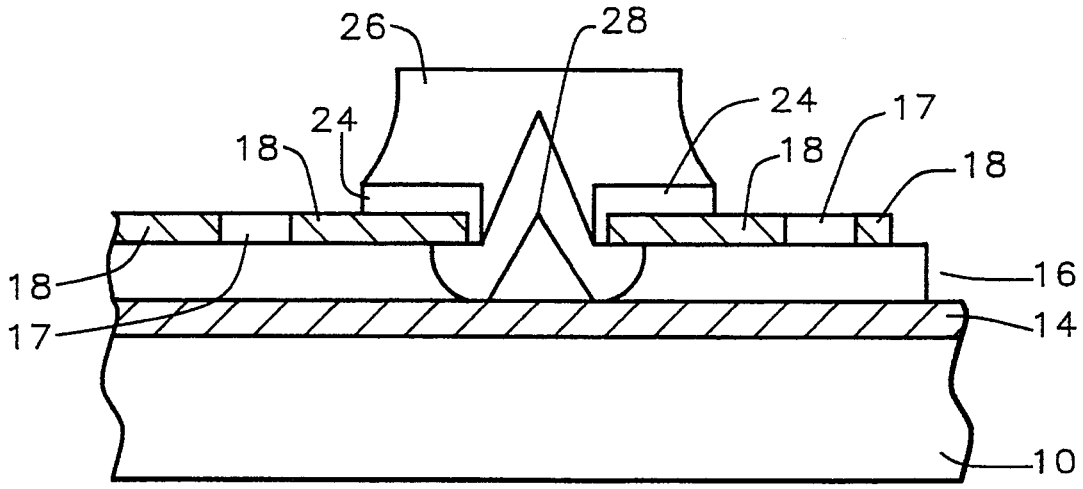

Referring now to FIG. 9, cathode conductor layer 14 is exposed by etching of layers 16 and 18 in order to provide an electrical contact point to the conductor. The last step needed to expose the microtips is removal of the remainder of layers 24 and 26 over the microtips, to form the structure shown in FIG. 10A.

Figure 10A:
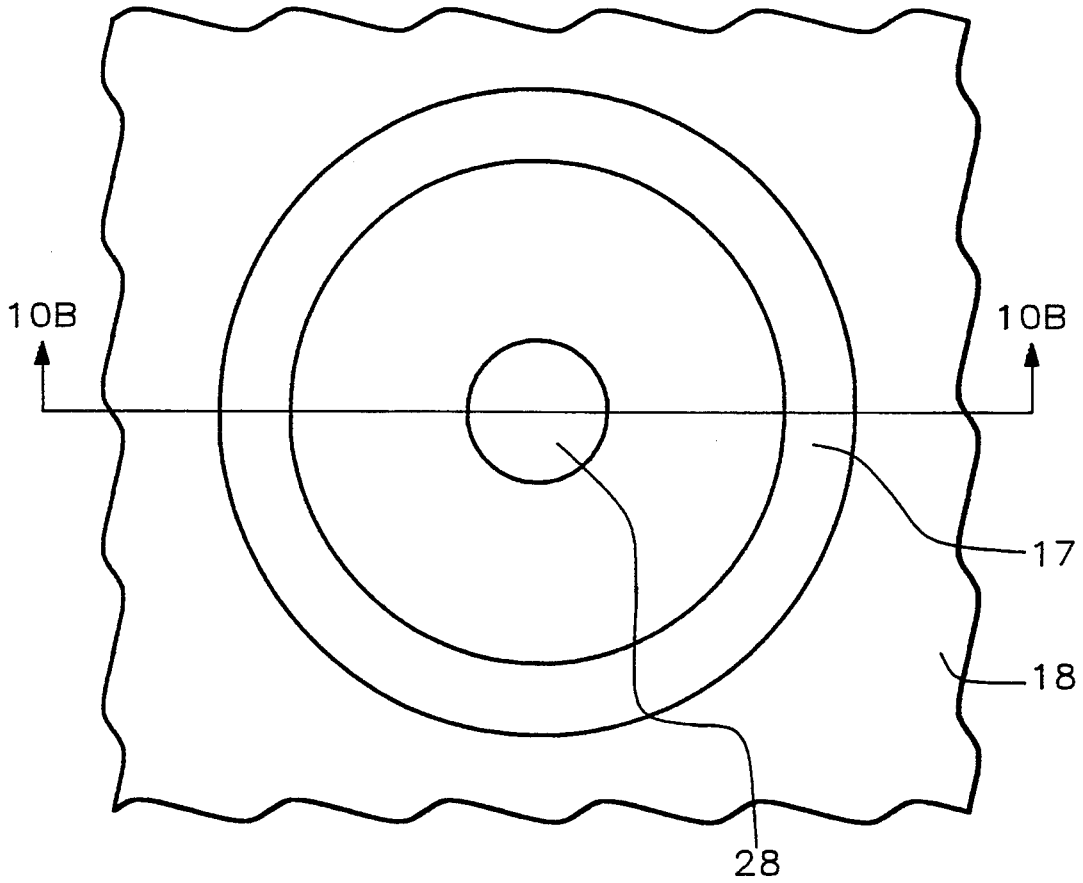
Figure 10B:
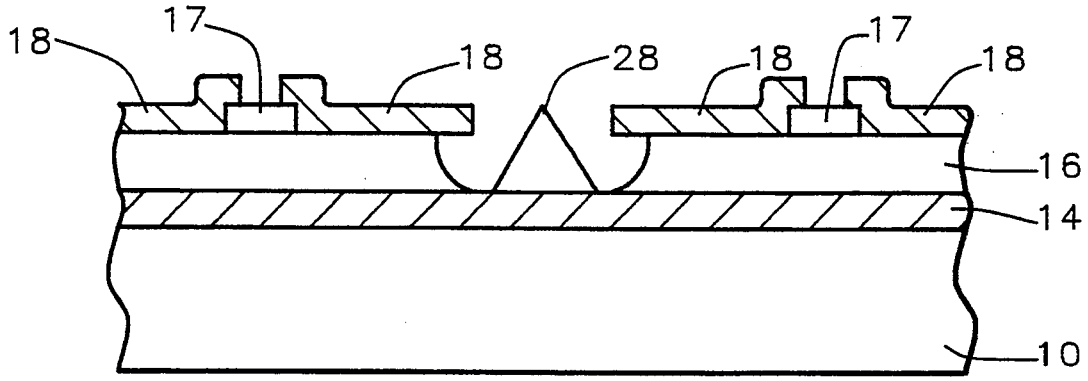
Figure 11:
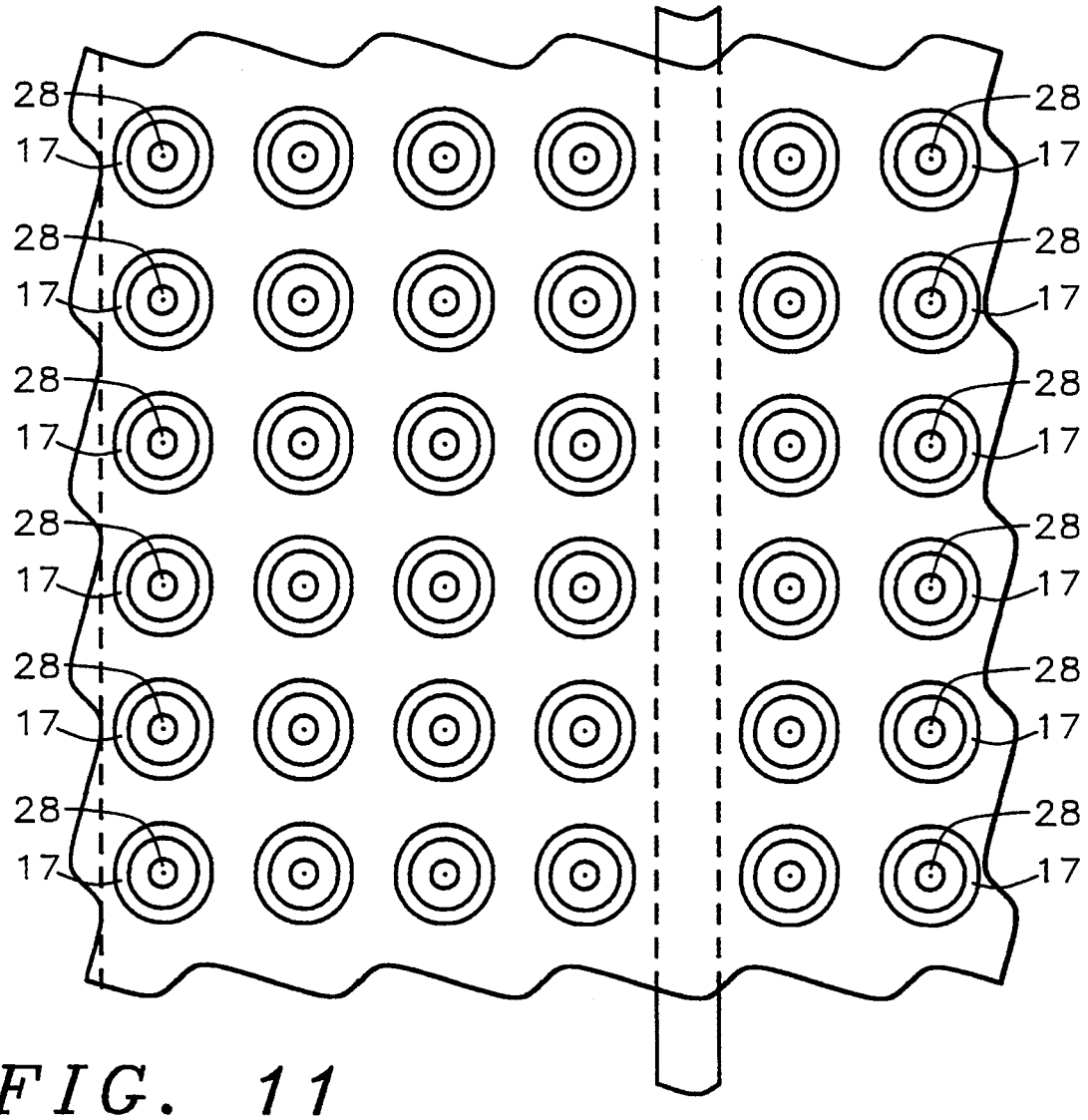

The result of these process steps is shown in FIG. 10A from a top view for each single field emission microtip redundancy structure. There are more than about 100 of these microtip structures at each pixel. FIG. 10B shows the cross-sectional view taken along line 10B—10B of FIG. 10A. FIG. 11 shows the top view of a pattern of field emission microtip structures at a pixel. It should be understood that the FIG. 11 is only a schematic illustration of a pixel and an adjacent half pixel, the actual number of the microtip structure can be up to 100 times more than are shown in the drawing.

The single tip redundancy can reduce the number of tips in each pixel, and there is no need for subpixels. If one tip fails in the prior art devices, the whole subpixel fails. This means that the number of subpixels should be about 10 or more, so when a subpixel fails only 10% of the tips in the pixel no longer work. Since the single tip redundancy method does not require subpixels, as few as 10 tips total can be used per pixel. Thus, a much smaller area is required for each pixel and a much higher resolution display can be achieved.

Figure 12:
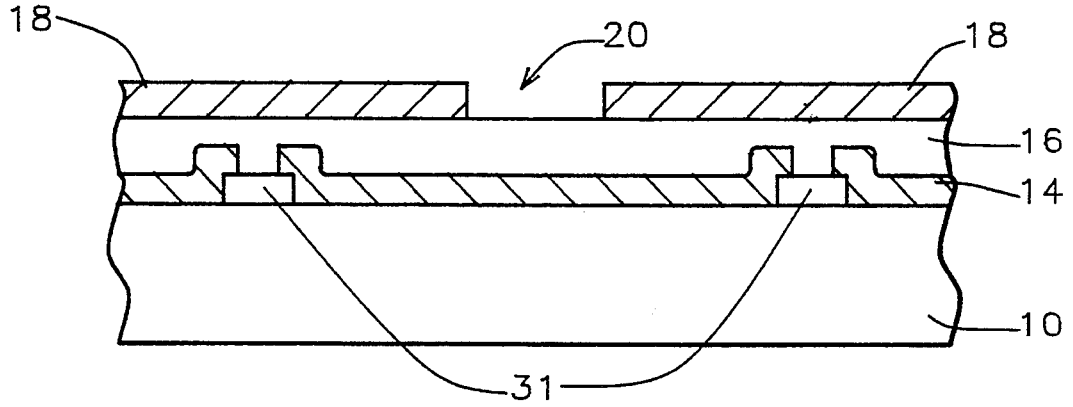
FIGS. 12 and 13 show a second embodiment method for fabricating the high resolution flat panel display having single field emission microtip redundancy and resulting structure.
Figure 13:
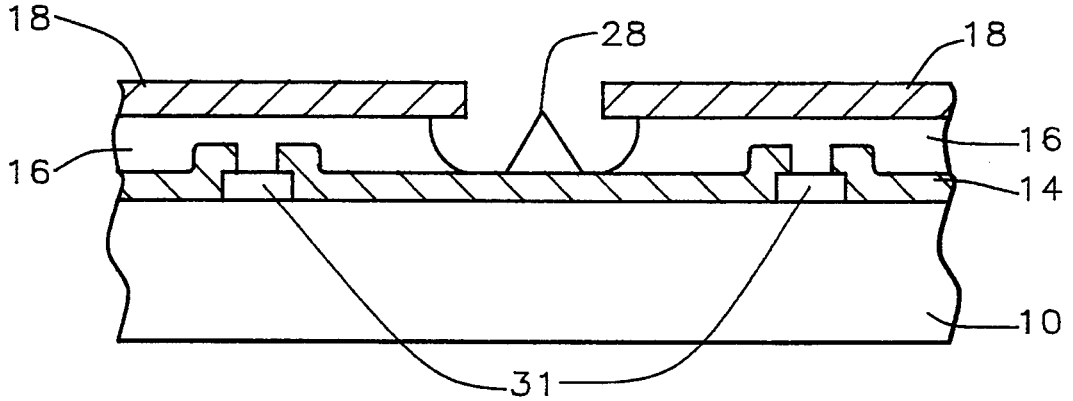

The second, and preferred, embodiment can be understood with reference to FIGS. 12 and 13. The circular resistive regions 31 in cathode conductor layer 14 can be formed by either the first or second method of the first embodiment. The only difference from these methods is that the pattern of openings (see opening 20 in FIG. 2A) at the center point of the circular resistive layer 17 is not needed in layer 14. The microtip 28 is then formed in the conventional way and the resultant structure is shown in FIG. 13.

Figure 14:
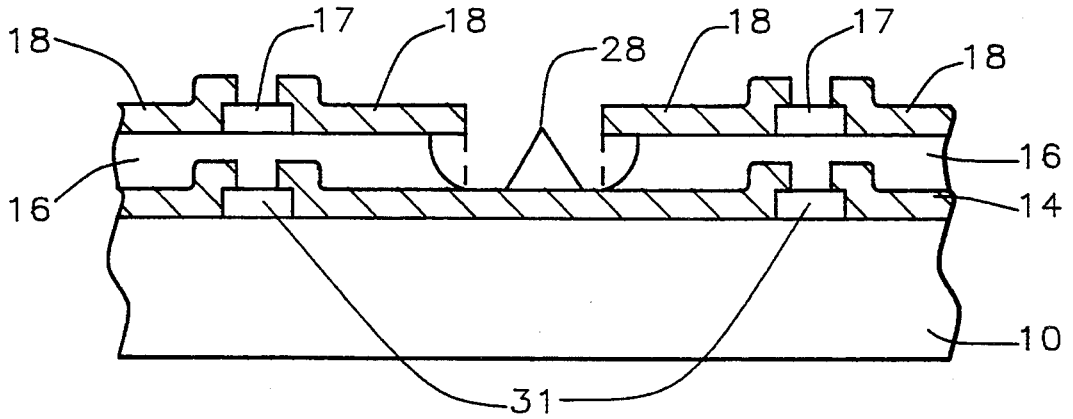
FIG. 14 shows the resulting structure of a third embodiment method for fabricating the high resolution flat panel display having single field emission microtip redundancy and resulting structure.

The third embodiment can be understood with reference to FIG. 14. This is accomplished by a combination of the previous two embodiments and results in circular resistive regions 17 and 31 in both the gate layer 18 and the cathode layer 14.

Figure 15A:
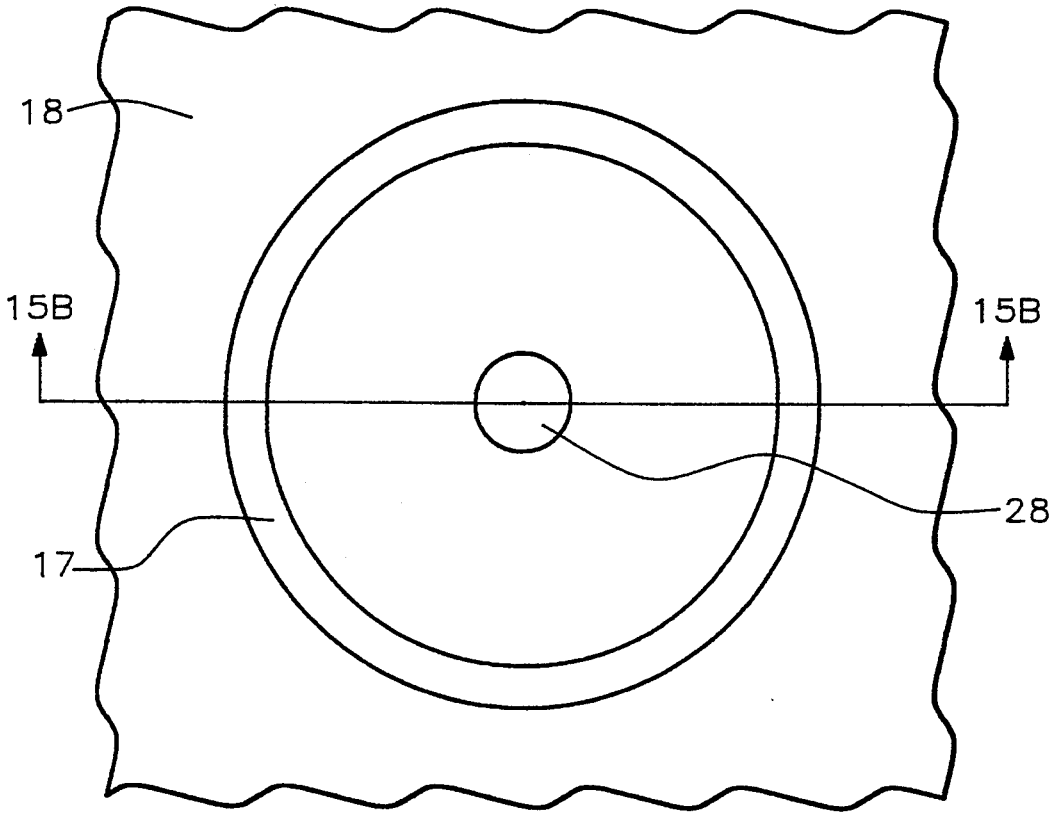
FIGS. 15A and 15B show the resulting structure of a fourth embodiment method for fabricating the high resolution flat panel display having single field emission microtip redundancy and resulting structure.
Figure 15B:
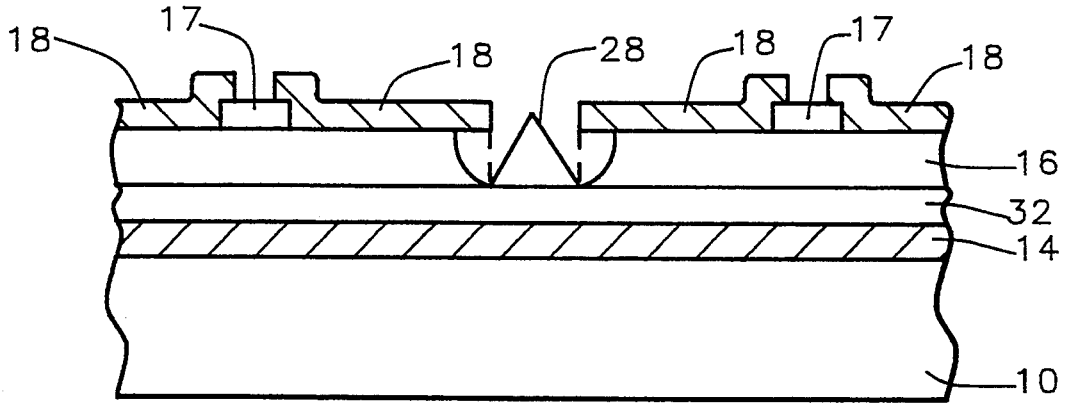

The fourth embodiment can be understood with reference to FIGS. 15A and 15B. A single resistive layer 32 is added to the first embodiment structure to create an entire resistive layer over the cathode while using the resistive circular region 17 around the microtip. This layer is formed on conductive layer 14 by depositing amorphous silicon or polycrystalline silicon and then doping with an ion implant to a proper resistivity.

The resistance of circular resistors in a pixel can be different, i.e., the width of each circuit resistor can be different (or equal), thus with this invention we can provide different load resistance of each microtip and the microtips in a display can have different operation points.

While the invention has been particularly shown and described with reference to the preferred embodiments thereof, it will be understood by those skilled in the art that various changes in form and details may be made without departing from the spirit and scope of the invention.

What is claimed is:

1. A high resolution matrix addressed flat panel display having single field emission microtip redundancy comprising:
   - a dielectric base substrate;
   - parallel, spaced conductors acting as cathode columns for said display being formed upon said substrate;
   - a layer of insulation over said cathode columns;
   - parallel, spaced conductors acting as gate lines for said display being formed over said layer of insulation orthogonally to said cathode columns;
   - the intersections of said cathode columns and gate lines are pixels of said display;
   - a plurality of openings at said pixels extending through said insulating layer and said gate lines;
   - at each of said pixels are a plurality of field emission microtips connected to and extending up from said cathode columns and into said plurality of openings; and
   - a circular resistive layer in said gate lines surrounding each of said field emission microtips whereby emission uniformity is obtained.

2. The flat panel display of claim 1 further comprising a resistive layer between said cathode columns and said microtips.

3. The flat panel display of claim 1 further comprising a second circular resistive layer in said cathode columns surrounding each of said field emission microtips.

4. The flat panel display of claim 1 wherein said circular resistive layer is composed of amorphous silicon having a resistance of between 1M to 100 G ohms.

5. The flat panel display of claim 1 wherein said circular resistive layer is composed of polycrystalline silicon.

6. The flat panel display of claim 1 wherein there are more than 100 of said field emission microtips at each of said pixels.

7. The flat panel display of claim 1 wherein each said circular resistive layer has a different resistance.

8. The flat panel display of claim 1 wherein said circular resistive layer has an outer diameter of between 4 and 5 microns.

9. A method of fabricating a high resolution matrix addressed flat panel display having cathode columns and gate lines and single field emission microtip redundancy, comprising:
   - providing a dielectric base substrate;
   - forming parallel, spaced conductors acting as said cathode columns for said display upon said substrate;
   - forming a layer of insulation over said cathode columns;
   - forming spaced conductors acting as gate lines for said display over said layer of insulation, orthogonally to the cathode columns;
   - the intersections of said cathode columns and gate lines are pixels of said display;
   - forming a plurality of openings at said pixels extending through said gate lines and said insulating layer;
   - forming at each of said pixels a plurality of field emission microtips connected to and extending up from said cathode conductor columns and into said plurality of openings forming parallel; and forming a circular resistive layer in said gate lines surrounding each of said field emission microtips, whereby emission uniformity is obtained.

10. The method of claim 9 wherein said forming said spaced conductors acting as gate lines, and said forming a circular resistive layer, further comprises the steps of:

forming a layer of silicon over said layer of insulation;

forming a first mask over location of said circular resistive layer;

ion implanting a first conductivity-imparting dopant into unmasked regions of said layer of silicon, whereby said unmasked regions are said gate lines and are made conductive by said first conductivity-imparting dopant;

removing said first mask;

forming a second mask to expose only location of said circular resistive layer;

ion implanting a second conductivity-imparting dopant into said location, whereby said circular resistive layer is made resistive by said second conductivity-imparting dopant; and removing said second mask.

11. The method of claim 10 wherein said layer of silicon is formed of amorphous silicon, and wherein said second conductivity-imparting dopant causes said circular resistive layer to have a resistance of between 1M to 100 G ohms.

12. The method of claim 10 wherein said layer of silicon is formed of polycrystalline silicon, and wherein said second conductivity-imparting dopant causes said circular resistive layer to have a resistance of between 1M to 100 G ohms.

13. The method of claim 9 wherein said forming said spaced conductors acting as gate lines, and said forming a circular resistive layer, further comprises the steps of:

forming a conductive layer over said layer of insulation;

forming an opening in said conductive layer at location of said circular resistive layer, whereby remainder of said conductive layer forms said gate lines;

depositing a layer of silicon over said conductive layer and in said opening;

ion implanting a conductivity-imparting dopant into said layer of silicon, whereby said conductivity-imparting dopant provides a resistance of between 1M and 100 G ohms; and forming said circular resistive layer by removing said layer of silicon in all regions except said location of said circular resistive layer.

14. The method of claim 9 wherein said forming said spaced conductors acting as gate lines, and said forming a circular resistive layer, further comprises the steps of:

forming a layer of silicon over said layer of insulation;

ion implanting a conductivity-imparting dopant into said layer of silicon, whereby said conductivity-imparting dopant provides a resistance of between 1M and 100 G ohms;

forming said circular resistive layer by removing said layer of silicon in all regions except said location of said circular resistive layer;

forming a conductive layer over said layer of insulation and over said circular resistive layer; and removing a portion of said conductive layer over said circular resistive layer, whereby remainder of said conductive layer forms said gate lines.

15. The method of claim 9 further comprising forming a resistive layer between said cathode columns and said microtips.

16. The method of claim 9 further comprising the step of forming a second circular resistive layer in said cathode columns surrounding each of said plurality of field emission microtips.

17. A high resolution matrix addressed flat panel display having single field emission microtip redundancy comprising:

a dielectric base substrate;

parallel, spaced conductors acting as cathode columns for said display being formed upon said substrate;

a layer of insulation over said cathode columns;

parallel, spaced conductors acting as gate lines for said display being formed over said layer of insulation at a right angle to said cathode columns;

the intersections of said cathode columns and gate lines are pixels of said display;

a plurality of openings at said pixels extending through said insulating layer and said gate lines;

at each of said pixels are a plurality of field emission microtips connected to and extending up from said cathode columns and into said plurality of openings; and a circular resistive layer in said cathode columns surrounding each of said field emission microtips whereby emission uniformity is obtained.

18. The flat panel display of claim 17 wherein said circular resistive layer is composed of amorphous silicon having a resistance of between 1M to 100 G ohms.

19. The flat panel display of claim 17 wherein said circular resistive layer is composed of polycrystalline silicon.

20. The flat panel display of claim 17 wherein said circular resistive layer has an outer diameter of between 4 and 5 microns.

21. The flat panel display of claim 17 wherein each said circular resistive layer has a different resistance.

22. A method of fabricating a high resolution matrix addressed flat panel display having cathode columns and gate lines and single field emission microtip redundancy, comprising:

providing a dielectric base substrate;

forming parallel, spaced conductors acting as said cathode columns for said display upon said substrate;

forming a layer of insulation over said cathode columns;

forming spaced conductors acting as gate lines for said display over said layer of insulation, orthogonally to the cathode columns;

the intersections of said cathode columns and gate lines are pixels of said display;

forming a plurality of openings at said pixels extending through said gate lines and said insulating layer;

forming at each of said pixels a plurality of field emission microtips connected to and extending up from said cathode conductor columns and into said plurality of openings forming parallel; and forming a circular resistive layer in said cathode columns surrounding each of said field emission microtips, whereby emission uniformity is obtained.

23. The method of claim 22 wherein said forming said spaced conductors acting as cathode columns, and said forming a circular resistive layer, further comprises the steps of:

forming a layer of silicon over said dielectric, base substrate;

forming a first mask over location of said circular resistive layer;

ion implanting a first conductivity-imparting dopant into unmasked regions of said layer of silicon, where:by said unmasked regions are said cathode columns and are made conductive by said first conductivity-imparting dopant;

removing said first mask;

forming a second mask to expose only location of said circular resistive layer;

ion implanting a second conductivity-imparting dopant into said location, whereby said circular resistive layer is made resistive by said second conductivity-imparting dopant; and removing said second mask.

24. The method of claim 22 wherein said forming said parallel, spaced conductors acting as cathode columns, and said forming a circular resistive layer, further comprises the steps of:

forming a conductive layer over said dielectric base substrate;

forming an opening in said conductive layer at location of said circular resistive layer, whereby remainder of said conductive layer forms said cathode columns;

depositing a layer of silicon over said conductive layer and in said opening;

ion implanting a conductivity-imparting dopant into said layer of silicon, whereby said conductivity-imparting dopant provides a resistance of between 1M and 100 G ohms; and forming said circular resistive layer by removing said layer of silicon in all regions except said location of said circular resistive layer.

25. The method of claim 22 wherein said forming said parallel, spaced conductors acting as cathode columns, and said forming a circular resistive layer, further comprises the steps of:

forming a layer of silicon over said dielectric base substrate;

ion implanting a conductivity-imparting dopant into said layer of silicon, whereby said conductivity-imparting dopant provides a resistance of between 1M and 100 G ohms;

forming said circular resistive layer by removing said layer of silicon in all regions except said location of said circular resistive layer;

forming a conductive layer over said layer of insulation and over said circular resistive layer; and removing a portion of said conductive layer over said circular resistive layer, whereby remainder of said conductive layer forms said cathode columns.

26. The method of claim 23 wherein said layer of silicon is formed of amorphous silicon, and wherein said second conductivity-imparting dopant causes said circular resistive layer to have a resistance of between 1M to 100 G ohms.

27. The method of claim 23 wherein said layer of silicon is formed of polycrystalline silicon, and wherein said second conductivity-imparting dopant causes said circular resistive layer to have a resistance of between 1M to 100 G ohms.

* * * * *